United States Patent [19]

Ciminelli et al.

[11] Patent Number: 4,964,753

[45] Date of Patent: Oct. 23, 1990

[54] THREE ROLL COMPACTOR

[75] Inventors: Michael A. Ciminelli, Webster; Jack Buck, Hemlock; Charles G. Weaver, Farmington; Darryle E. Fowler, Victor, all of N.Y.

[73] Assignee: Stone Construction Equipment, Inc., Honeoye, N.Y.

[21] Appl. No.: 207,854

[22] Filed: Jun. 17, 1988

[51] Int. Cl.[5] ..... E01C 19/26

[52] U.S. Cl. ..... 404/122; 404/117

[58] Field of Search ..... 404/103, 117, 122, 123, 404/124; 180/6.2, 6.48, 6.7, 19.1, 19.3, 20, 210, 212

[56] References Cited

U.S. PATENT DOCUMENTS

| | | | |
|---|---|---|---|
| 3,309,972 | 3/1967 | Peters | 404/117 |
| 3,318,210 | 5/1967 | Schwamborn et al. | 180/6.2 X |
| 3,463,063 | 8/1969 | Caron et al. | 404/124 |
| 3,737,243 | 6/1973 | Dresher | 404/122 |
| 3,763,944 | 10/1973 | Kaltenegger | 180/20 X |
| 3,814,531 | 6/1974 | Carnahan et al. | 404/117 |
| 4,219,287 | 8/1980 | Marks | 404/117 |
| 4,732,507 | 3/1988 | Artzberger | 404/117 |
| 4,775,262 | 10/1988 | Guntharp et al. | 404/103 |

FOREIGN PATENT DOCUMENTS

| | | | |
|---|---|---|---|
| 3532198 | 3/1987 | Fed. Rep. of Germany | 404/122 |

*Primary Examiner*—Stephen J. Novosad
*Assistant Examiner*—Gay A. Spahn
*Attorney, Agent, or Firm*—Fleit, Jacobson, Cohn, Price, Holman & Stern

[57] ABSTRACT

A soil compactor having three compacting rollers supported from a frame with each of the rollers being independently powered by a hydraulic motor with the controls for the hydraulic motors being located at the rear of the compactor so that an operator walking behind the compactor will be able to control movement of the compactor. A vibration device is supported from a frame in generally a central position between the single front roller and the pair of rear rollers. The vibration device is an eccentric weight on a shaft driven at high speeds by a hydraulic motor with the central location of the vibration device producing a vibrating effect to aid in compaction and also aiding in maneuverability by providing a "floating" effect.

9 Claims, 3 Drawing Sheets

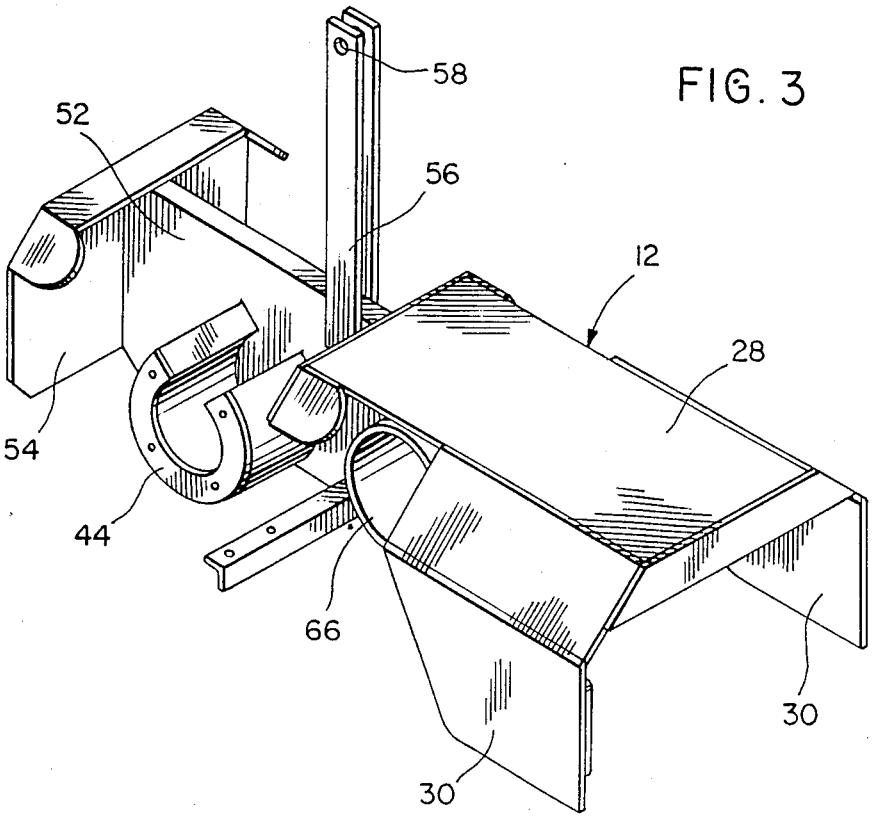
FIG. 3
FIG. 4
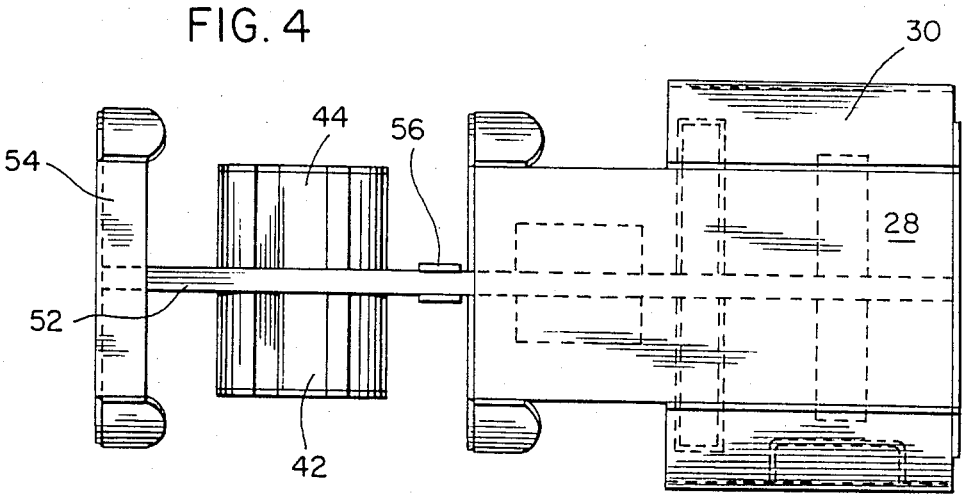
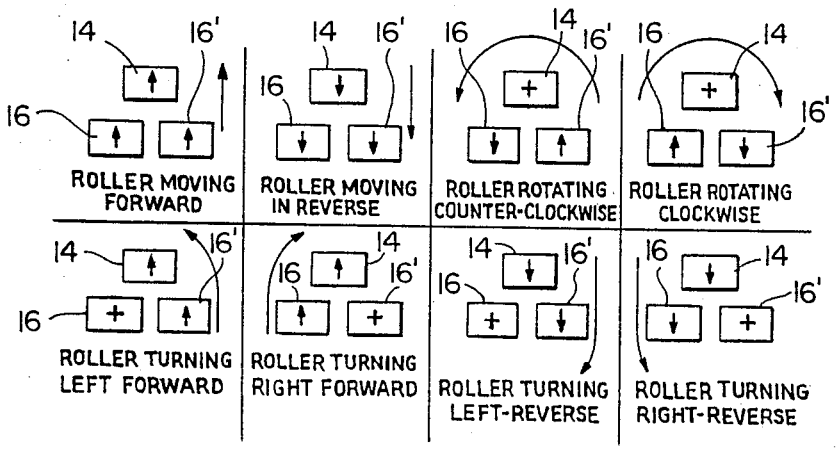
FIG. 5

THREE ROLL COMPACTOR

BACKGROUND OF THE INVENTION

1. Field of the Invention

The present invention generally relates to a soil compactor having three compacting rollers supported from a frame with each of the rollers being independently powered by a hydraulic motor with the controls for the hydraulic motors being located at the rear of the compactor so that an operator walking behind the compactor will be able to control movement of the compactor. A vibration device is supported from a frame in generally a central position between the single front roller and the pair of rear rollers. The vibration device is an eccentric weight on a shaft driven at high speeds by a hydraulic motor with the central location of the vibration device producing a vibrating effect to aid in compaction and also aiding in maneuverability by providing a "floating" effect.

2. Information Disclosure Statement

Compactors for soil, fill dirt and other fill material are well-known and generally use a rotatable eccentric weight to impart vibratory movement to a compacting element that is in engagement with the material to be compacted. Previously known devices include compactors with plates which engage the material to be compacted. Another type of compactor utilizes a roller or rollers which engage the soil to be compacted and also enable movement of the compactor. None of the presently known compactors utilize the specific arrangement of components and operational procedures incorporated into this invention.

SUMMARY OF THE INVENTION

An object of the present invention is to provide a compactor for soil or other fill material provided with a frame supporting a centrally located forward roller or drum and a pair of rearwardly located, transversely spaced rollers or drums with each roller or drum being independently driven by a hydraulic motor with control valves being provided by which the rollers can be driven in a forward or reverse direction at desired speeds to provide steering control for the compactor which enables it to be effectively maneuvered while compacting soils or other fill material in narrow trenches and other confined areas.

Another object of the invention is to provide a compactor having a vibration device mounted from a supporting frame centrally between the single forward roller and the pair of rear rollers with the vibration device being independently driven by a hydraulic motor at a high speed to vibrate the rollers or drums to compact the soil with which they are engaged.

A further object of the invention is to provide a compactor in accordance with the preceding objects in which the control valves are located to the rear of the compactor to enable a walk behind operator to effectively control operation of the compactor and to enable the operator to effectively maneuver the compactor by independently controlling the direction and speed of each roller or drum.

Still another object of the invention is to provide a compactor in accordance with the preceding objects in which the location of the vibration device centrally between the front and rear rollers produces a floating effect on the compactor to facilitate steering and maneuverability of the compactor.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a perspective view of the frame structure utilized in the compactor.

FIG. 4 is a plan view of the frame structure.

FIG. 5 is a schematic illustration of the control modes of the compactor.

DESCRIPTION OF THE PREFERRED EMBODIMENT

Figure 1:
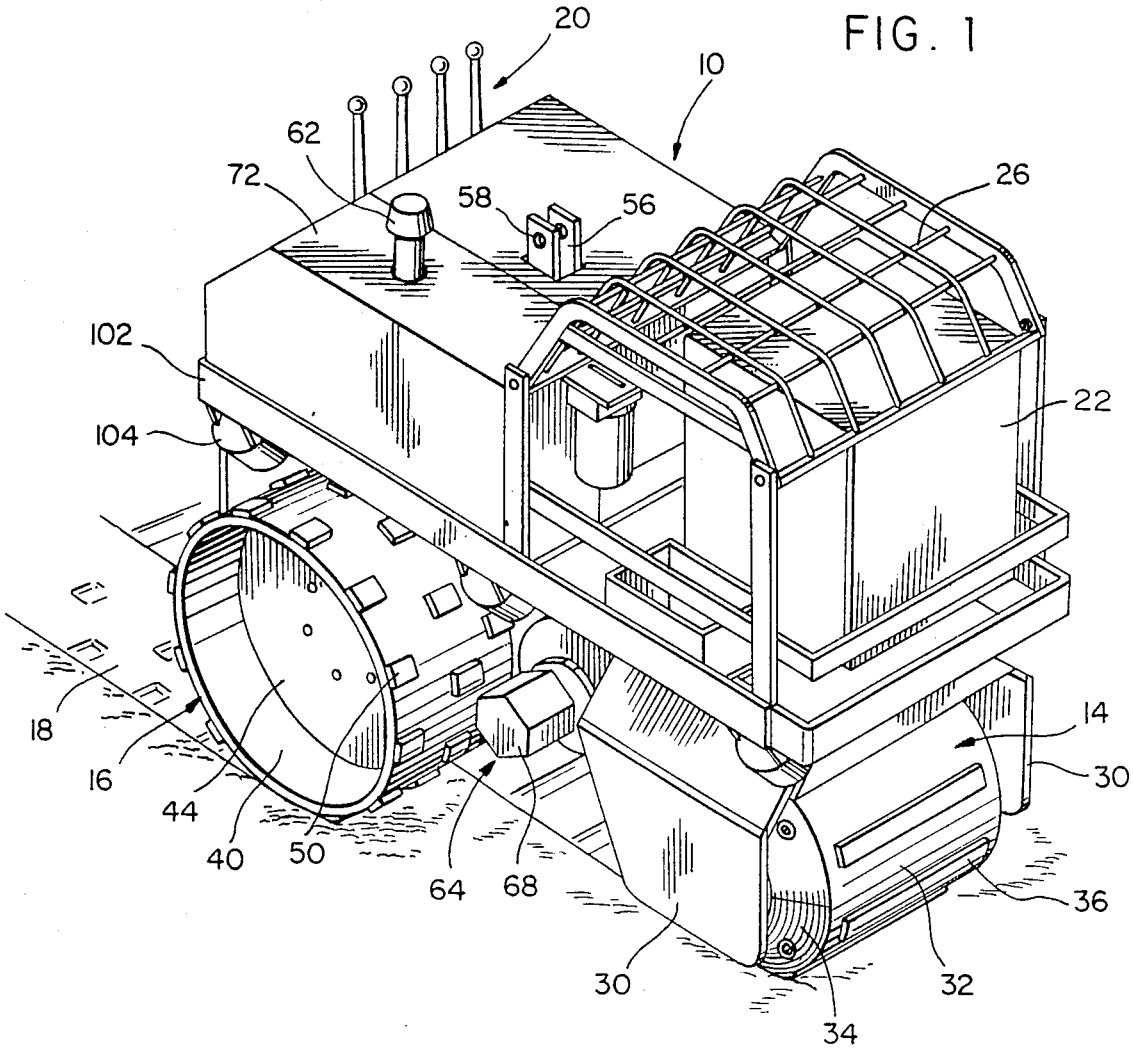
FIG. 1 is a front perspective view of the three roll walk behind compactor of the present invention.

Referring now specifically to the drawings, the compactor of the present invention is generally designated by the numeral 10 and includes a frame 12 which supports a single front roller 14 and a pair of rear rollers 16 with it being pointed out that the rollers 14 and 16 may be considered drums and are in contact with the soil or fill material 18 in a narrow trench or other confined area. The control arrangement for the compactor is generally designated by numeral 20 and is located at the rear of the compactor 10 so that a walk behind operator can control the compactor.

Figure 6:
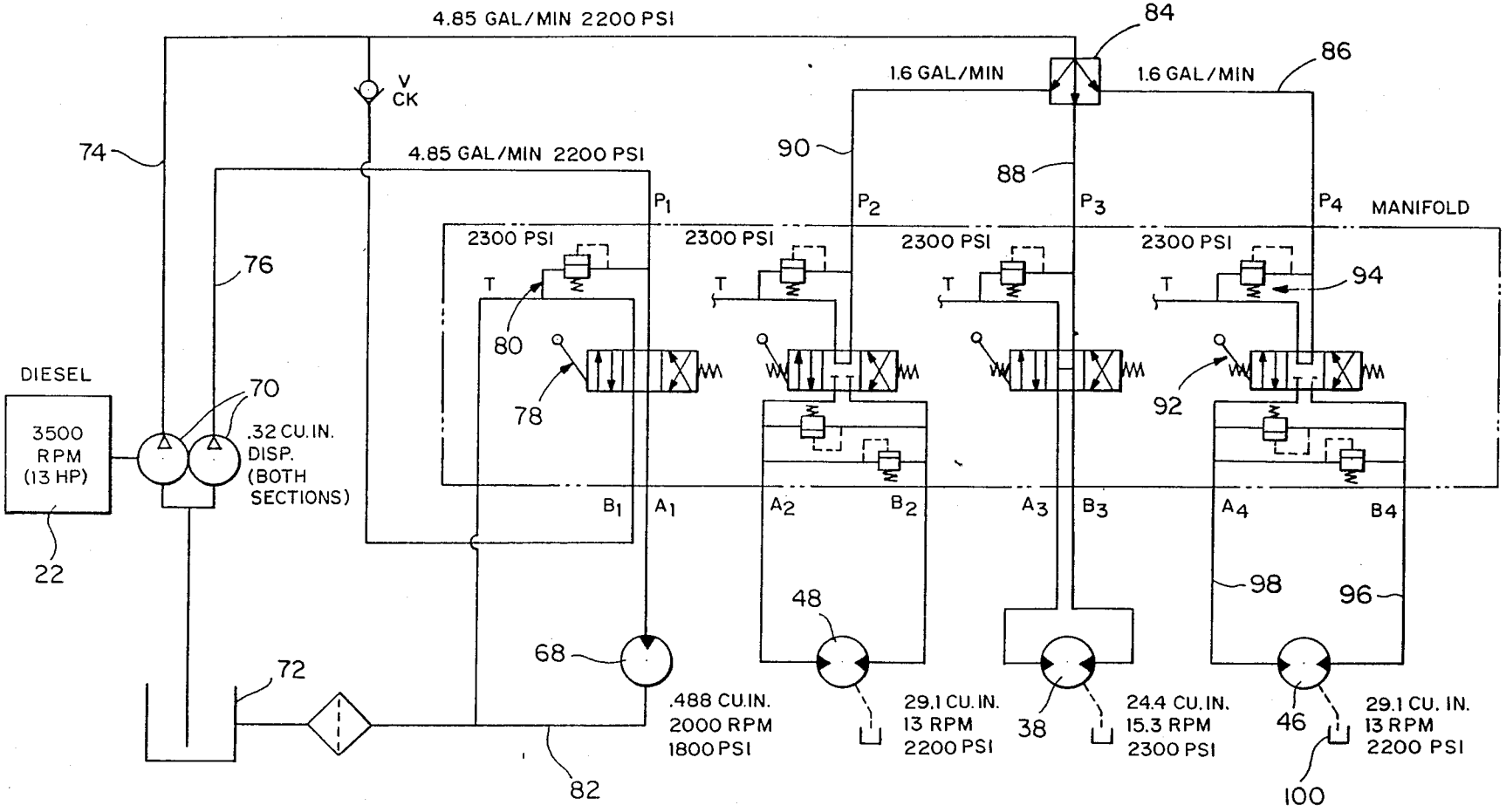
FIG. 6 is a schematic view illustrating the drive and control arrangements for the compactor.

The frame supports a prime mover such as a diesel engine 22 protected by a guard 26. The prime mover 22 is an internal combustion engine such as a diesel engine having the output capabilities as indicated in FIG. 6. The frame 12 includes a supporting deck or plate 28 to support the prime mover and the plate 28 includes depending support plates 30 oriented vertically and in spaced parallel relation to each other to rotatably support and journal the front roller 14 which is in the form of a cylindrical member 32 having end plates 34 and traction cleats 36 thereon with the roller or drum 14 being journalled by suitable bearing structures and driven by a hydraulic motor 38. The front roller 14 is driven by the hydraulic motor 38 in a forward or reverse direction about a horizontal axis with the plates 30 and 28 journalling the front roller and preventing any pivotal movement about a vertical axis.

Figure 2:
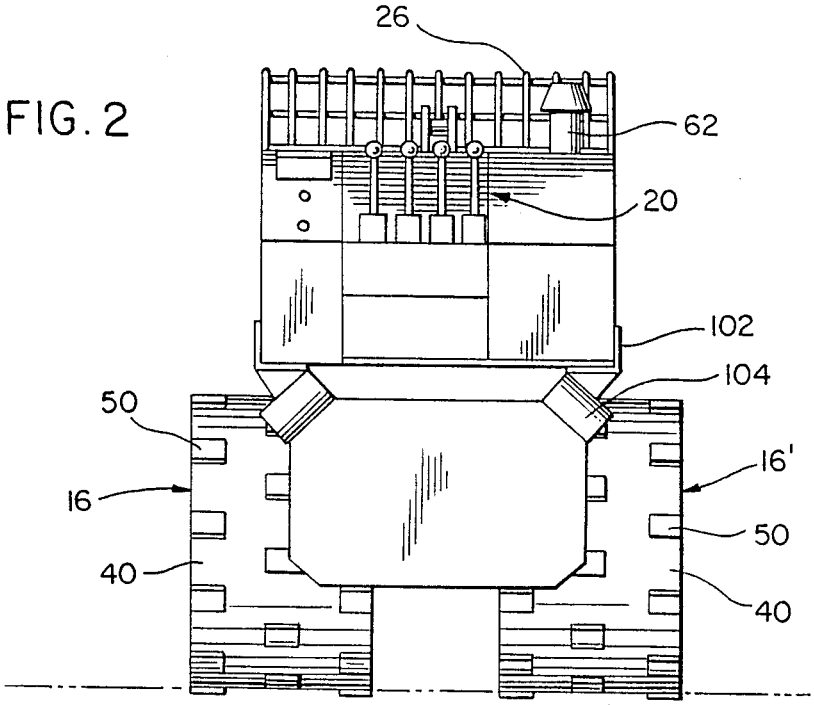
FIG. 2 is a rear elevational view of the compactor illustrating the relationship of the rear rollers and the control valves for the hydraulic motors for controlling operation of the compactor.

The rear rollers 16 are each provided with a cylindrical member 40 having a circular plate or disk 42 rigid therewith with a stub axle or other suitable structures rotatably mounting the plate or disk 42 from a bearing structure 44 with the rear rollers 16 being driven by hydraulic motors 46 and 48 as illustrated in FIG. 6. The exterior of the cylindrical member 40 is provided with a plurality of staggered lugs or cleats 50 thereon which are arranged in transversely spaced circumferential rows with the lugs in each row being circumferentially spaced as compared to the cleats 36 which are parallel to each other, circumferentially spaced and extend transversely of the front cylindrical member 32 as illustrated in FIGS. 1 and 2.

The frame 12 includes a vertically disposed plate or frame member 52 and a rear vertical plate 54 extending transversely at the rear of the vehicle with upstanding brackets 56 being attached to the plate 52 and provided with apertures 58 for receiving a lifting device in order to hoist the compactor onto or from a truck or the like. Also, the area above the plate 52 is provided with a hydraulic reservoir or tank 72 with a filler/vent pipe 62 being provided forwardly of the control assembly 20 with these components being conventional. The control assembly 20 may be provided with gauges indicating fuel supply, operating conditions of the engine and control arrangements to enable the engine to be started and stopped, all of which are conventional components that do not form any specific part of the present invention.

Centrally located between the front roller 14 and the rear rollers 16 is a vibration device 64 supported in a transverse housing 66 with the vibration device being a shaft having an eccentric weight rigidly affixed thereto and rotatably supported from the housing 64 and driven at a high speed by a hydraulic motor 68.

As illustrated in FIG. 6, the prime mover 22 drives a dual pump 70 which pumps hydraulic fluid from a storage tank 72 and discharges hydraulic fluid through two discharge lines 74 and 76 at the same pressure and volume as indicated. The discharge line 76 is connected to the hydraulic motor 68 which drives the vibration device 64 through a control valve 78 with a pressure relief bypass valve 80 being incorporated into the hydraulic circuit with the hydraulic fluid returning to the tank 72 through a return line 82. The discharge line 74 from the pump 70 extends to a divider 84 which divides the flow volume into three fluid pressure lines 86, 88 and 90 with each pressure line having the same pressure and carrying one-third of the capacity of discharge line 74 as indicated by the indicia adjacent the pressure lines 86, 88 and 90 in FIG. 6. The pressure supply line 86 is connected to rear roller motor 46 through a control valve 92 which is capable of driving the motor 46 in either direction with a bypass valve 94 being provided. From the valve 92, the fluid flows through either of lines 96 and 98 which are provided with cross connector lines with relief valves therein so that the motor 46 can be driven in either direction and return flow from the motor 46 will be through a return line assembly 100 to the tank 72. The pressure supply line 90 to the motor 48 is provided with identical controls and the pressure supply line to front roller motor 38 is also provided with a similar control valve and bypass arrangement with it being noted that the front roller motor 38 does not include the cross-over pressure relief lines. The control valve 92 for the motors 38, 46 and 48 are each designated by reference numeral 92 in FIG. 6 and FIGS. 1 and 2 with the control valve 78 for the motor 68 for the vibration device also being designated in FIGS. 1 and 2. The control valves are commercially available items and the various pressure relief valves, control valves, check valves and related structures are associated with a manifold in a conventional manner so that the walk-behind operator can independently control each of the motors as to rotational direction and can stop any or all of the motors.

FIG. 5 illustrates schematically the operational modes of the front and rear rollers. For purposes of description, the front roller is designated by reference numeral 14, the left rear roller is designated by numeral 16 and the right rear roller is designated by numeral 16'. The arrow alongside of the footprint of the rollers indicates the direction of movement of the compactor with the arrows on the rollers indicating the direction of rotation of the rollers. Beginning with the upper left hand imprint, all of the rollers are being driven in a forward direction so that the compactor will move forwardly in a straight line. In the next illustration, all of the rollers are being driven in a reverse direction and the compactor is moving to the rear. In the third illustration, the front roller 14 is stationary. The left rear roller 16, as observed from the rear, is driven in a reverse direction and the right rear roller 16 is being driven in a forward direction thus causing the compactor t rotate to the left or counterclockwise as indicated by the arrow. In the fourth illustration in the top row, the front roller 4 is in a stationary position, the left rear roller 16 is being driven in a forward direction and the right rear roller 16' is being driven in a reverse direction thus causing the compactor to rotate to the right or in a clockwise direction as indicated by the arrow.

In the left illustration on the bottom row, the forward roller 14 is being driven forwardly, the left rear roller 16 is being hydraulically locked in stationary position and the right rear roller 16 is being driven forwardly thus causing the compactor to turn to the left as it moves forwardly. In the next illustration, the front roller 14 is driven forwardly, the left rear roller 16 is driven forwardly and the right rear roller 16' is hydraulically locked, thus causing the compactor to turn to the right as it moves forwardly. In the next illustration, the front roller 14 is driven in reverse, the left rear roller 16 is hydraulically locked and the right rear roller 16' is driven to the rear, thus causing the compactor to turn to the left as it moves in reverse. The last illustration in the bottom row includes an arrangement in which the front roller 14 is driven to the rear, the left rear roller 16 is driven to the rear and the right rear roller 16' is hydraulically locked, thus causing the compactor to move to the rear and turn to the right as illustrated by the arrow. When the compactor is stationary, all three rollers are hydraulically locked. Thus, by manipulating the control valves for the motors 38, 46 and 48, the compactor may be maneuvered in a desired manner.

The three rollers which are independently driven by a hydraulic motor controlled by a hydraulic valve provides unique steering capabilities and maneuverability. The central location of the vibration device produces maximum compaction with the three drum or roller arrangement covering the entire surface area being traversed by the compactor. The vibration or eccentric force produced by the vibration device is transmitted to the ground in a most efficient manner through the three point or three roller or drum contact with the ground surface. The unique three roller arrangement with independently counterrotating rollers produces a unique steering arrangement aided by the vibration device. The vibration device is a conventional eccentric weight welded or otherwise fixed to a shaft driven at high speeds by the hydraulic motor 68. The eccentric weight, when rotated, produces a vibrating effect on the compactor which aids in compaction and also aids in maneuverability by creating a "floating" effect on the compactor. The floating effect aids in the rotation of the compactor in either direction and also the turning movement while moving either in a forward or reverse direction by lifting or "floating" the front drum or roller while the two rear rollers counterrotate, thus eliminating the side skidding of the front roller to some extent since the vibration device tends to float the front of the compactor and thus float the front roller 14.

The various components of the hydraulic system are conventional in and of themselves and are arranged to provide independent driving control of each of the hydraulic motors and to provide a pressure relief bypass and includes conventional piping or tubing, check valves, filters and other components conventionally employed on hydraulic power circuits. The structure of the frame and the manner in which the rollers and vibration device are supported and mounted are conventional with the engine, tank and the like being constructed on a platform 102 supported from the frame 12 by conventional shock mounts 104 so that the engine, pump, hydraulic fluid tank and related structures are not subject to vibration by the vibration device.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A compactor comprising a frame, a front roller rotatably supported below the frame in contact with soil to be compacted, a pair of rear rollers rotatably mounted from the frame for engagement with soil to be compacted, said rear rollers being spaced behind the front roller and said rear rollers being spaced transversely and in alignment with each other, a vibration device mounted on the frame between the front roller and rear rollers, means drivingly connected to each of the rollers to independently drive each of the rollers in a forward and reverse direction and drive means for the vibration device operative independently of the roller drive means.

2. The structure as defined in claim 1 wherein each of said roller drive means includes a hydraulic motor connected directly to the roller which it drives and independent control valve means for each roller drive motor.

3. The structure as defined in claim 1 wherein said vibration device is attached to the frame centrally between the front roller and rear rollers, said means driving said vibration device floating the front of the compactor and front roller in relation to the soil surface to enable rotation of the compactor about a generally vertical axis when the rear rollers are counterrotated and the vibration device is operated to impart vertical vibratory movement to the compactor.

4. The structure as defined in claim 3 wherein said means controlling the compactor includes hydraulic valves associated with a manifold with each valve including an operating handle for controlling driving direction of each of the rollers and controlling operation of the vibration device.

5. The structure as defined in claim 3 wherein said front roller is mounted between a pair of rigid, generally parallel vertical disposed plates that are rigidly connected to said frame, said rear rollers being disposed forwardly of a rear plate depending from the frame to protect a walk behind operator.

6. A walk-behind compactor comprising a frame, front and rear soil compacting and frame supporting rollers rotatably mounted from said frame, a vibration device mounted from said frame between the front and rear rollers for imparting vibration to the frame, means mounting said rollers from said frame to impart vibration from said frame to said rollers, independent drive means for each of said rollers and said vibration device, and control means at the rear of the frame, said control means operatively associated with said drive means to independently control operation of the rollers and vibration device, said control means including manually grasped control members positioned for access by a single walk-behind operator and enable independent control of the rollers for directional control of the compactor.

7. The compactor as defined in claim 6 wherein said rollers are independently driven by separate drive means and arranged with a single front roller and two rear rollers, all of said rollers being mounted from the frame by means preventing steerable movement about a vertical axis thereby requiring manipulation of the speed and rotational direction of the rollers to directionally control the compactor.

8. A walk-behind compactor comprising a rigid frame, a front roller rotatably supported below the frame in contact with soil to be compacted, a pair of rear rollers rotatably supported below the frame for engagement with soil to be compacted, said rear rollers being spaced behind the front roller and said rear rollers being spaced transversely and in transverse alignment with each other, a vibration device supported from the frame between the front roller and rear rollers, independent drive means drivingly connected to each of the rollers to independently drive each of the rollers in a forward and reverse direction and drive means drivingly connected to the vibration device operative independently of the roller drive means, rearwardly extending control means for each of said drive means, each of said control means including a manually grasped control member, said vibration device imparting vibration to the frame, said frame imparting vibration to the rollers with vibration imparted to the single front roller enabling the front roller to move over the soil surface with reduced drag when the rear rollers are counterrotating to turn the compactor about a vertical axis.

9. The compactor as defined in claim 8 wherein all of said rollers are mounted from the frame by means preventing steerable movement about a vertical axis and preventing pivotal movement about a horizontal axis thereby requiring manipulation of the speed and rotational direction of the rollers and operation of the vibration device to directionally control the compactor.

* * * * *